US009033759B2

(12) United States Patent
Rinck

(10) Patent No.: US 9,033,759 B2
(45) Date of Patent: May 19, 2015

(54) CONVERTIBLE HEADGEAR

(75) Inventor: Lionel Rinck, Vichy (FR)

(73) Assignee: Plushball, Vichy (FR)

( * ) Notice: Subject to any disclaimer, the term of this patent is extended or adjusted under 35 U.S.C. 154(b) by 345 days.

(21) Appl. No.: 13/518,829

(22) PCT Filed: Dec. 23, 2010

(86) PCT No.: PCT/FR2010/052897

§ 371 (c)(1),
(2), (4) Date: Aug. 27, 2012

(87) PCT Pub. No.: WO2011/077060

PCT Pub. Date: Jun. 30, 2011

(65) Prior Publication Data

US 2012/0317698 A1 Dec. 20, 2012

(30) Foreign Application Priority Data

Dec. 24, 2009 (FR) ..... 09 06343

(51) Int. Cl.
*A63H 33/00* (2006.01)
*A42B 1/00* (2006.01)
*A63H 3/02* (2006.01)

(52) U.S. Cl.
CPC ..... *A63H 33/004* (2013.01); *A42B 1/006* (2013.01); *A63H 3/02* (2013.01)

(58) Field of Classification Search
CPC ... A63H 33/00; A63H 33/003; A63H 33/004; A42B 1/006
USPC ..... 2/209.11, 209.12, 209.13; 446/26, 27, 446/28, 71, 72, 73, 75, 76
See application file for complete search history.

(56) References Cited

U.S. PATENT DOCUMENTS

| | | | | |
|---|---|---|---|---|
| 1,407,165 | A | 2/1922 | Pajeau | |
| 3,077,051 | A * | 2/1963 | Quinones, Jr | 446/27 |
| 4,543,669 | A * | 10/1985 | Katz | 2/84 |
| 4,614,505 | A * | 9/1986 | Schneider et al. | 446/372 |
| 5,328,399 | A * | 7/1994 | Reynolds | 446/27 |
| 5,450,629 | A * | 9/1995 | Gilstrap | 2/209.11 |
| 5,768,714 | A * | 6/1998 | Bowhey | 2/410 |
| 5,799,335 | A * | 9/1998 | Ethier | 2/209.11 |
| 5,907,871 | A * | 6/1999 | Austin | 2/209.12 |
| 6,126,507 | A * | 10/2000 | Lieberman | 446/327 |
| 7,044,615 | B2 * | 5/2006 | Gesten | 362/106 |
| 7,774,863 | B2 * | 8/2010 | Garza | 2/209.11 |

FOREIGN PATENT DOCUMENTS

| | | |
|---|---|---|
| WO | 0006276 A1 | 2/2000 |
| WO | 2008016315 A1 | 2/2008 |

OTHER PUBLICATIONS

International Search Report dated May 6, 2011, International Application No. PCT/FR2010/052897.

* cited by examiner

*Primary Examiner* — Kurt Fernstrom
(74) *Attorney, Agent, or Firm* — Patterson & Sheridan, LLP

(57) ABSTRACT

Headgear that can be converted into another object, comprising a figurine provided with a hollow base which, in at least one configuration, defines an object including a volume for receiving an element. In a second configuration, the hollow base can be turned partially inside out to form a second object including another reception volume and, in a third configuration, the hollow base can be turned fully inside out to form a third object.

7 Claims, 5 Drawing Sheets

CONVERTIBLE HEADGEAR

The invention relates to convertible headgear.

Headgear here refers to a clothing accessory that is adapted to cover a person's head, whether an adult or a child. This headgear can be a hat, cap, helmet, beret, or bonnet.

Known from U.S. Pat. No. 5,328,399 is flexible fabric headgear, which can be converted into another object by turning it inside out. This headgear, configured as a helmet or cap once turned inside out, forms a sports item, such as a ball, or a reproduction of a car. The walls making up this headgear are padded so that, when they are turned inside out, they maintain the shape of the sports item or car reproduction. This headgear is provided with a closing member of the type having slide channels. Such headgear can only be converted into one other object.

These are the drawbacks the invention aims to resolve by proposing headgear that can be converted into different objects.

To that end, the invention relates to headgear that can be converted into at least one other object, characterized in that it comprises a figurine provided with a hollow base which, in at least one configuration, defines an object including a volume for receiving an element and in that in a second configuration, the hollow base can be turned partially inside out to form a second object including another reception volume and, in a third configuration, the hollow base can be turned fully inside out to form a third object.

Thus, several objects can be made with a hollow figurine making up the headgear.

According to advantageous, but non-mandatory aspects of the invention, the headgear can incorporate one or more of the following features:

- The headgear is equipped with a member for closing the receiving volumes of the base.
- The headgear is equipped with a member forming a member for keeping the headgear in position in at least one configuration and a gripping member in at least one other configuration.
- The headgear comprises means for emitting music or an audio message.
- The headgear comprises a lighting device.
- The material making up the base and the dimensions thereof are adapted so that, in a given configuration, an object is obtained with a density greater than the density of the headgear when the latter is in the other configurations.

Figure 1:
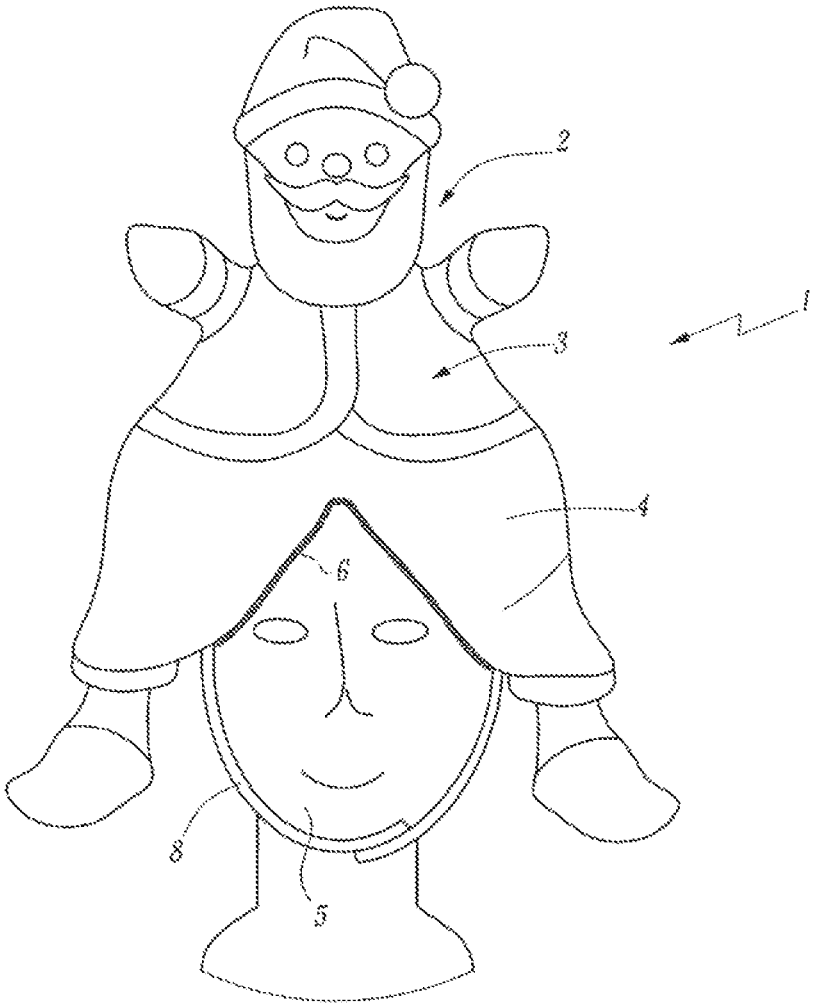
Figure 2:
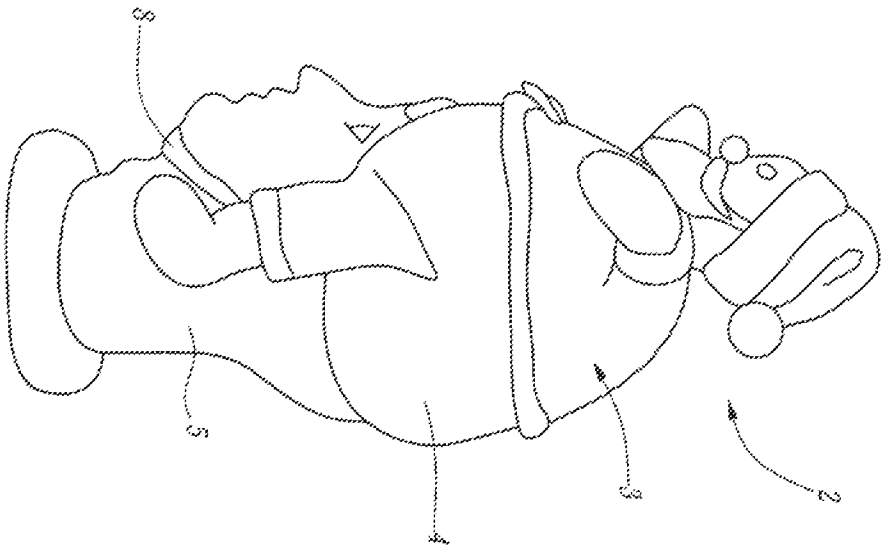
Figure 3:
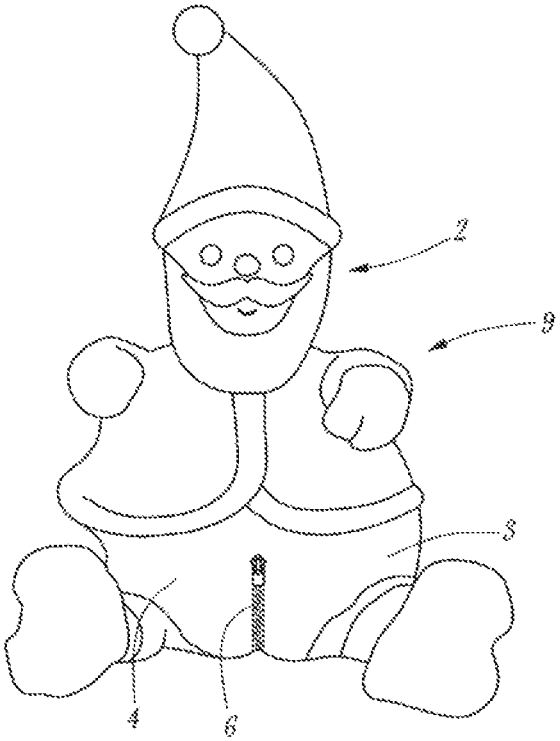
Figure 6:
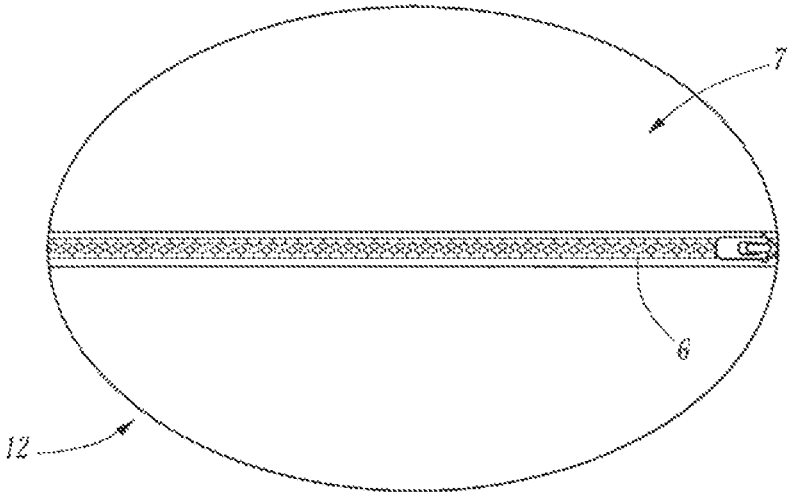
Figure 4:
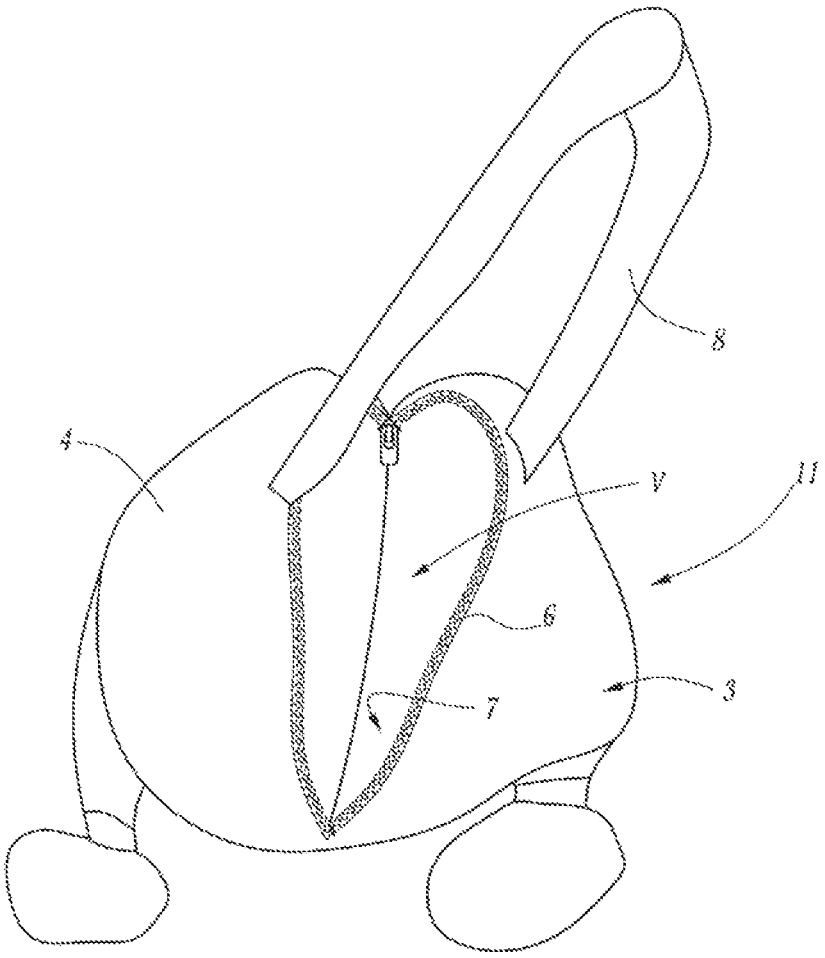
Figure 5:
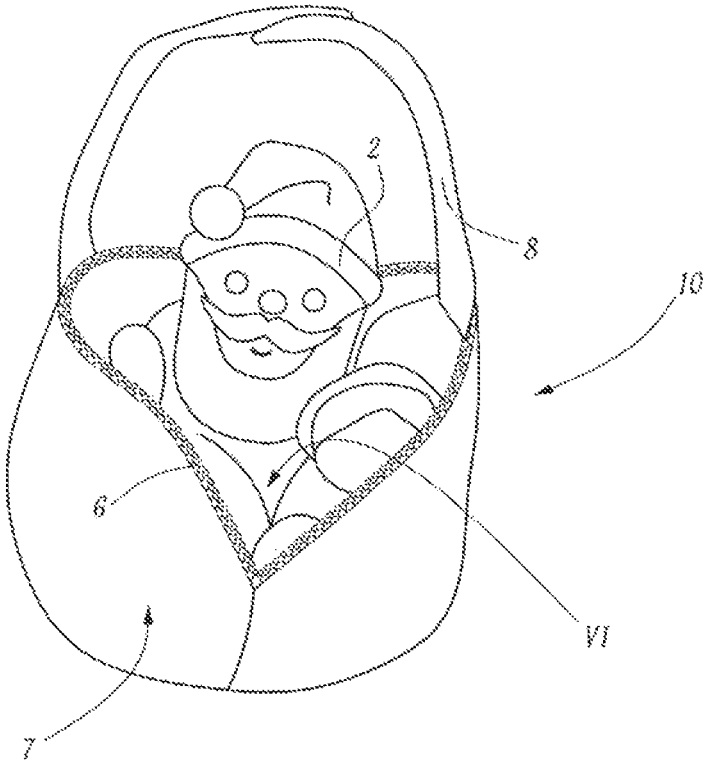

The invention will be better understood, and other features and advantages thereof will appear more clearly, upon reading the following description of one embodiment of convertible headgear, according to the invention, provided solely as an example and done in reference to the appended drawings, in which:

FIG. 1 is a front illustration of headgear in a first configuration, positioned on a mannequin's head, FIG. 2 is a side view, on the same scale, of the headgear of FIG. 1, FIG. 3 is a front view of the headgear, its hollow base being closed and the headgear being in a second configuration where it forms a second object, FIG. 4 is a bottom view of the headgear, on another scale, the base being open, in another configuration where the headgear forms another object, FIG. 5 is a front view of the headgear, in a third configuration where it forms a third object, the base being partially turned inside out, and FIG. 6 is a larger-scale side view of the headgear, the base being turned completely inside out in a fourth configuration, where the headgear forms a fourth object.

FIG. 1 shows headgear 1 comprising a figurine 2; in this case, the figurine depicts a Santa Claus. Alternatively, it may be a character, an animal, an object, or a graphic representation.

The figurine 2 is made from fabric, leather, or any other flexible textile. This material is reinforced by a filler, of the foam or synthetic wool type. This reinforcing material ensures the structure of the headgear 1 and gives it its outside appearance. To that end, the headgear 1 is made from textile panels, which are more or less padded depending on the position they occupy, and which are sewn together to form the figurine 2. Reinforcements on the panels and/or certain seams are provided so as to allow repeated manipulation of the headgear without risk of deterioration.

The outer surface 3 of the figurine 2 is advantageously made from a fluffy fabric, soft to the touch. Alternatively, the outer surface 3, or part of said outer surface 3, is made from another textile, for example a reflective and/or impermeable fabric.

The base 4 of the figurine 2, i.e. in the example the lower portion of the body thereof in light of FIG. 1, is hollow and defines a volume V for receiving an element. This element is, in a first configuration illustrated in FIGS. 1 and 2, the head 5 of a user. In other words, a hat is formed as the first object. In that case, the receiving volume V is adapted to effectively cover the head 5 of a user. The dimensions of the figurine 2 are such that they cover not only the head 5 of the user, but also part of the ears. In one embodiment that is not illustrated, the figurine 2 includes a portion that can form an eyeshade in said first configuration.

In a second configuration, the element received in the volume V is a decorative or clothing item, for example pajamas. A bag 11 is then formed as the second object.

In this configuration, the bag 11 thus formed can be used open or closed. To that end, the base 4 is provided with a closing member 6 for closing the receiving volume V. In the example, this is a slide channel clasp. Alternatively, it may be a hook and loop fastener, a pressure fastener or a press-stud fastener.

The inner surface 7 of the base 4 is advantageously made from a material similar to that of the outer surface 3 of the figurine 2, so that when the base 4 is turned inside out, the same appearance and/or the same colors are seen as those of the outer surface 3. Alternatively, the materials and/or the colors are different.

Advantageously, as illustrated in FIGS. 1 and 2, two straps 8 form two members for keeping the figurine 2 in position in the "hat" configuration, in position on the head 5 of a user. These straps 8 are connected to one another by a device that is known in itself, for example hook and loop strips, a stud, or simply knotted. In an alternative that is not illustrated, the maintaining members making it possible to fasten the headgear on the head of the user are formed directly by elements of the figurine 2, for example the legs, and not by straps.

When the headgear is in the second configuration, i.e. in the form of a bag 11, as illustrated in FIG. 4, the straps 8 form a gripping member once they are connected to one another.

The panels making up the figurine 2 are adapted so that, when the receiving volume V is closed by the closing member 6, the base 4 of the figurine 2 forms a seat making it possible to keep the figurine 2 in at least one position, for example seated, as shown in FIG. 3. In that configuration, when the straps 8 are fastened on the inner surface 7 of the base 4, they are hidden in the closed volume V. In an alternative that is not illustrated, the position is different. The headgear 1 is thus in a third configuration where, when the base 4 is closed, the headgear forms a toy, for example a doll 9 or a decorative object.

When the base 2 is turned partially inside out after having opened it so that its inner surface 7 is oriented toward the outside, another receiving volume V1 is defined whereof the dimensions are adapted to receive the rest of the figurine 2, in this case the arms, the body, the legs, and the head of the figurine 2 as illustrated in FIG. 5. The volume V1 is smaller than the volume V.

The closing member 6 can advantageously be maneuvered from the two outer 3 and inner 7 surfaces of the base 4. Another configuration of the headgear 1 is thus obtained, shown in FIG. 5, where it forms a fourth object in which part of the figurine 2 remains visible, for example the head and the top of the body, the rest being inserted into the volume V1 of the base 4 thus partially turned inside out. The fourth object thus defined is of the basket or pram type 10 receiving part of the figurine 1. This is therefore a toy that can be used by a child. In this configuration, a gripping member is formed similar to that illustrated in FIG. 4 by connecting the straps 8.

When, as illustrated in FIG. 6, the movement turning the inner surface 7 of the base 4 inside out toward the outside is continued, the figurine 2 and the straps 8 are completely inserted into the volume V1, when they are fastened on the outer surface 7 defined by the inside out base 4. After closing the closing member 6, a fifth configuration is obtained forming a fifth object 12. The dimensions and shape of the base 4 thus completely turned inside out are such that the volume V1 is completely occupied by the figurine 2 and the straps 8. One thus obtains a fifth object 12 that is dense and rigid enough to form a sports item, such as a ball. In that case, the ball 12 shown in FIG. 6 is oval, such as a rugby ball or football. In an alternative that is not shown, it may be spherical, such as a basketball, volleyball, handball, soccer ball, or baseball.

In the event a spherical ball is produced, for example a soccer ball, the entire figurine 2 is made from identical pentagon-shaped panels, in which a more or less significant quantity of reinforcing material is slid so as to obtain the different objects as they are illustrated.

Advantageously, in one embodiment not described, the figurine comprises a transmitter member, transmitting either a voice message or music, for example a small box inserted into the figurine.

The figurine can also be provided with a lighting member, for example a LED fastened on the figurine. This lighting member can be associated with the member for transmitting a voice message or music.

In another embodiment not illustrated, the figurine comprises a head, for example made from silicone, showing a character or a well-known person.

The invention claimed is:

1. Headgear that can be converted into at least one other object, the headgear comprising a figurine provided with a hollow base which, in at least a first configuration, defines an object including a reception volume for receiving an element, the hollow base being turnable partially inside out in a second configuration to form a second object including another reception volume, the hollow base being turnable fully inside out in a third configuration to form a third object, and wherein in the first configuration, the reception volume is adapted to cover the head of a user, and an inner surface of the figurine covers the head of the user so that the figurine is entirely visible.

2. The headgear according to claim 1, wherein the headgear is equipped with a closing member for closing the reception volumes of the base.

3. The headgear according to claim 2, wherein the headgear is equipped with a member forming a member for keeping the headgear in position in a given configuration and a gripping member in at least one other configuration.

4. The headgear according to claim 1, wherein the headgear comprises means for emitting music or an audio message.

5. The headgear according to claim 1, wherein the headgear comprises a lighting device.

6. The headgear according to claim 1, wherein a material making up the base and dimensions thereof are adapted so that, in a given configuration, the object is obtained with a density greater than the density of the headgear when the latter is in the other configurations.

7. The headgear according to claim 2, wherein in another configuration of the headgear, the reception volume of the hollow base is closed by the closing member so that the headgear forms a fourth object.

* * * * *